US010838349B2

(12) United States Patent
Nagata

(10) Patent No.: US 10,838,349 B2
(45) Date of Patent: Nov. 17, 2020

(54) DEVELOPING DEVICE

(71) Applicant: CANON KABUSHIKI KAISHA, Tokyo (JP)

(72) Inventor: Teppei Nagata, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/561,134

(22) Filed: Sep. 5, 2019

(65) Prior Publication Data

US 2019/0391526 A1 Dec. 26, 2019

Related U.S. Application Data

(63) Continuation of application No. PCT/JP2018/010359, filed on Mar. 9, 2018.

(30) Foreign Application Priority Data

Mar. 9, 2017 (JP) ..... 2017-045429

(51) Int. Cl.
*G03G 21/16* (2006.01)
*G03G 15/10* (2006.01)

(52) U.S. Cl.
CPC ..... *G03G 21/1647* (2013.01); *G03G 15/10* (2013.01); *G03G 21/1676* (2013.01)

(58) Field of Classification Search
CPC ..... G03G 21/1647; G03G 21/1676; G03G 15/10; G03G 15/0121; G03G 2221/163
See application file for complete search history.

(56) References Cited

U.S. PATENT DOCUMENTS 9,291,948 B2 3/2016 Tanner et al.
9,811,027 B2 11/2017 Tanner et al.
(Continued)

FOREIGN PATENT DOCUMENTS

JP 2006-084744 A 3/2006
JP 2010-102350 A 5/2010
(Continued)

OTHER PUBLICATIONS

Machine translation of JP 2006-084744 A (publication date of Mar. 30, 2006) printed on Feb. 24, 2020.*
(Continued)

*Primary Examiner* — Sophia S Chen
(74) *Attorney, Agent, or Firm* — Venable LLP

(57) ABSTRACT

An image forming apparatus includes a power source, a developing cartridge including a developing rotating member to carry a developer to develop an electrostatic latent image formed on an image bearing member, and a motor configured to rotationally drive the developing rotating member. A supporting frame, dismountably mounted to the image forming apparatus, dismountably supports the developing cartridge and dismountably supports the motor. In addition, an electrical contact, provided on the supporting frame, electrically contacts to the power source to supply electric power to the motor in a state that the supporting frame is mounted to the image forming apparatus, and a drawer portion dismountably supports the supporting frame and is capable of being pulled out from the image forming apparatus to dismount the supporting frame from the image forming apparatus in a state that the supporting frame is supported.

4 Claims, 8 Drawing Sheets

(56) References Cited

U.S. PATENT DOCUMENTS

| | | | | |
|---|---|---|---|---|
| 2008/0159774 | A1* | 7/2008 | Tanabe | G03G 21/1842 399/90 |
| 2013/0322918 | A1* | 12/2013 | Igarashi | G03G 21/1676 399/110 |
| 2014/0205314 | A1 | 7/2014 | Chang et al. | |
| 2016/0062300 | A1* | 3/2016 | Takagi | G03G 21/1647 464/157 |
| 2019/0271937 | A1* | 9/2019 | Komatsu | G03G 15/10 |

FOREIGN PATENT DOCUMENTS

| | | | |
|---|---|---|---|
| JP | 2015-515648 | A | 5/2015 |
| JP | 2015-184339 | A | 10/2015 |
| JP | 2016-224418 | A | 12/2016 |

OTHER PUBLICATIONS

International Search Report issued in parent International Application No. PCT/JP2018/010359 dated Oct. 4, 2018.

* cited by examiner

DEVELOPING DEVICE

This application is a continuation of International Patent Appln. No. PCT/JP2018/010359 filed Mar. 9, 2018.

TECHNICAL FIELD

The present invention relates to a developing device including a developer carrying member rotatable while carrying a developer.

BACKGROUND ART

In an image forming apparatus, an electrostatic latent image on an image bearing member is developed by a developing device. As such an image forming apparatus, an image forming apparatus of a dry developing type using powder toner and an image forming apparatus of a wet developing type using a liquid developer in which toner is dispersed in a liquid (Japanese Laid-Open Patent Application Tokuhyo 2015-515648) exist.

The developing device includes a developing roller as a developer carrying member, but the developing roller is driven by a motor as a driving source. As such a developing device, a constitution in which the developing device is mountable to and dismountable from an apparatus main assembly of the image forming apparatus has been conventionally known.

Problems to be Solved by the Invention

In the case of the constitution in which the developing device is mountable to and dismountable from the apparatus main assembly, the case where the driving source is provided in the developing device and the case where the driving source is provided directly to the developing device exist. In the former case, when the developing device is exchanged at an exchange time of consumable parts such as the developing roller, the driving source is exchanged together with the developing device even if the driving source is not out of order, so that a running cost increases. On the other hand, in the latter case, the driving source is provided in the apparatus main assembly, and therefore, the driving source is not readily exchanged, so that a maintenance property lowers.

The present invention aims at providing a constitution capable of realizing a reduction in running cost and improvement in maintenance property.

Means for Solving the Problems

The present invention comprises a developing cartridge including a developer carrying member rotatable while carrying a developer; and a supporting member, including a motor for rotationally driving the developer carrying member, for supporting the developing cartridge so as to be mountable to and dismountable from the supporting member, wherein the developing cartridge and the supporting member are integrally mountable to and dismountable from an image forming apparatus.

Further, the present invention comprises a developing cartridge including a developer carrying member rotatable while carrying a developer; and a supporting member, including a swing motor for swinging the developer cartridge, for supporting the developing cartridge so as to be mountable to and dismountable from the supporting member and so as to be swingable in a mounted state of the developing cartridge, wherein the developing cartridge and the supporting member are integrally mountable to and dismountable from an image forming apparatus. Further, the present invention comprises a developing cartridge including a developer carrying member rotatable while carrying a developer, for developing an electrostatic latent image formed on an image bearing member; and a supporting member, including a motor for imparting a driving force to the developing cartridge, for supporting the developing cartridge so as to be mountable to and dismountable from the supporting member, wherein the developing cartridge and the supporting member are integrally mountable to and dismountable from an image forming apparatus.

Effect of the Invention

According to the present invention, the reduction in running cost and the improvement in maintenance property can be realized.

EMBODIMENTS FOR CARRYING OUT THE INVENTION

First Embodiment

A first embodiment will be described using FIG. 1 to FIG. 9. First, a schematic structure of an image forming apparatus of this embodiment will be described using FIG. 1 and FIG. 2.

Image Forming Apparatus

Figure 1:
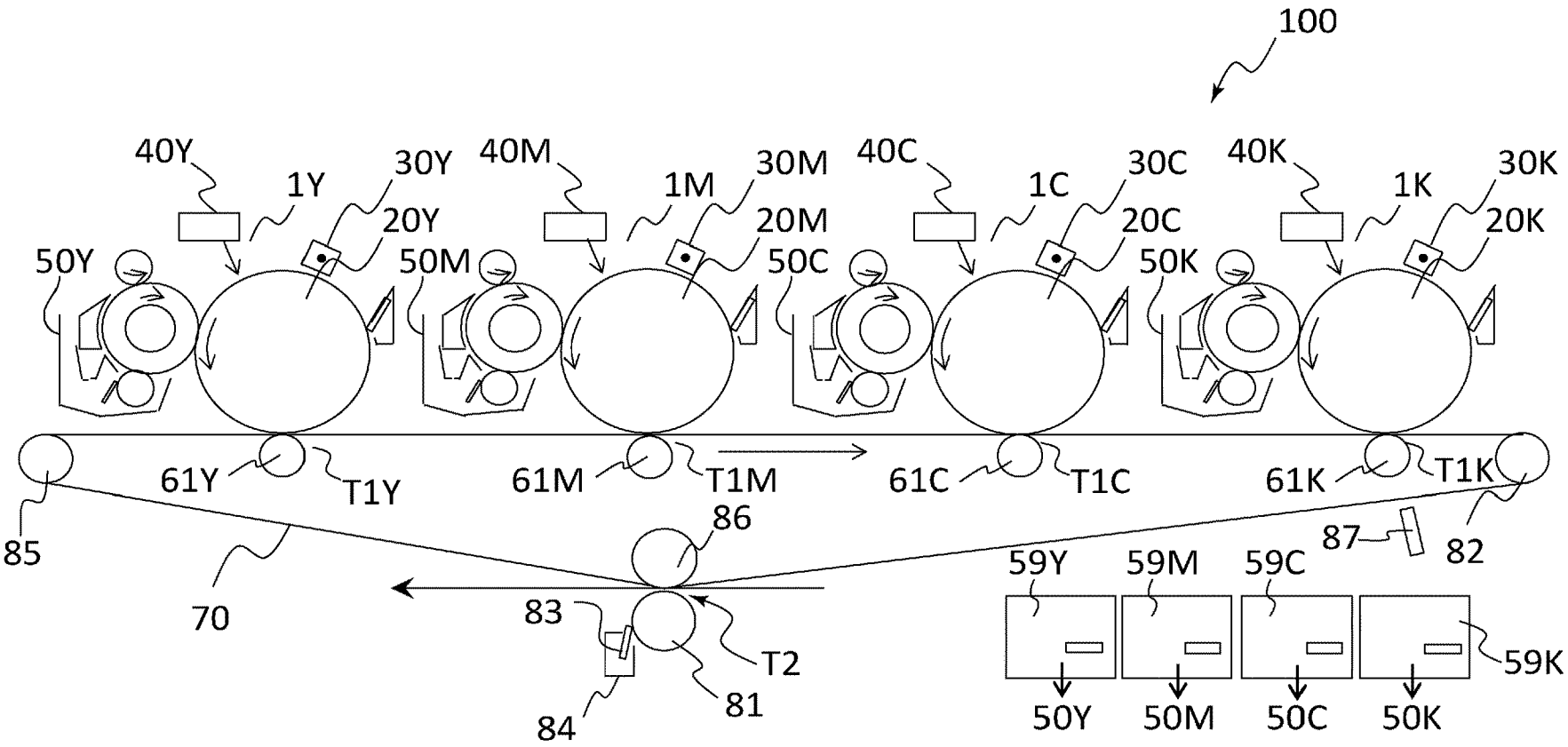
FIG. 1 is a schematic structural view of an image forming apparatus according to an embodiment.

As shown in FIG. 1, an image forming apparatus 100 is a full-color printer of an electrophotographic type in which four image forming portions 1Y, 1M, 1C and 1K provided correspondingly to four colors of yellow (Y), magenta (M), cyan (C) and black (K). In this embodiment, the image forming apparatus 100 is of a tandem type in which the image forming portions 1Y, 1M, 1C and 1K are provided along a rotational direction of an intermediary transfer belt 70 described later. The image forming apparatus 100 forms a toner image on a recording material depending on an image signal from an external device communicatably connected with an image forming apparatus main assembly, for example. As the recording materials, a sheet material such as a sheet, a plastic film, a cloth or the like is cited.

The respective image forming portions 1Y, 1M, 1C and 1K form toner images of the respective colors on photosensitive members 20Y, 20M, 20C and 20K (on image bearing members) as image bearing members with use of liquid developers each containing toner and a carrier liquid. Detailed structures of the image forming portions will be described later.

The intermediary transfer belt 70 as an intermediary transfer member is an endless belt stretched by a driving roller 82, a follower roller 85 and an inner secondary transfer roller 86, and is rotationally driven while being contacted to the photosensitive members 20Y, 20M, 20C and 20K and an outer secondary transfer roller 81. At positions opposing the photosensitive members 20Y, 20M, 20C and 20K through the intermediary transfer belt 70, primary transfer rollers 61Y, 61M, 61C and 61K are provided and form primary transfer portions T1Y, T1M, T1C and T1K. Further, at the primary transfer portions T1Y, T1M, T1C and T1K, the four color toner images are successively transferred superposedly from the photosensitive members 20Y, 20M, 20C and 20K onto the intermediary transfer belt 70, so that a full-color toner image is formed on the intermediary transfer belt 70. Incidentally, for example, only a toner image of a single color such as black can also be formed on the intermediary transfer belt 70.

At a position opposing the inner secondary transfer roller 86 through the intermediary transfer belt 70, the outer secondary transfer roller 81 is provided and forms a secondary transfer portion T2. The single-color toner image or the full-color toner image formed on the intermediary transfer belt 70 is transferred onto the recording material at the x secondary transfer portion T2. That is, at the secondary transfer portion T2, a voltage of, for example, +1000 V is applied to the outer secondary transfer roller 81, and the inner secondary transfer roller 86 is kept at 0 V, so that toner particles on the intermediary transfer belt 70 are secondary-transferred onto a surface of the recording material.

Incidentally, the liquid developer which is not transferred on the recording material is removed by a cleaning device (not shown) contacting the intermediary transfer belt 70. To the outer secondary transfer roller 81, a blade 83 is contacted, and the liquid developer deposited on the outer secondary transfer roller 81 is scraped off by the blade 83 and is collected in a collecting portion 84. The toner image transferred on the recording material is fixed on the recording material by an unshown fixing device.

Further, on the intermediary transfer belt 70, a test image for monitoring an image density is periodically drawn (formed) between image forming operations, and the density thereof is detected by a toner image density sensor 87 provided upstream of the secondary transfer portion T2. In this embodiment, the toner image density sensor 87 is an optical sensor and detects the density of the toner image from intensity of specular reflection light and diffused reflection light of LED light with which the test image is irradiated. On the basis of information on the detected toner image density, optimization of the image density is carried out by feed-back-control. Specifically, the image density is adjusted by adjusting a voltage applied to a film forming electrode 51 described later.

Image Forming Portion

The image forming portions 1Y, 1M, 1C and 1K will be described using FIG. 1 and FIG. 2. The image forming portions 1Y, 1M, 1C and 1K include developing devices 50Y, 50M, 50C and 50K, respectively. The developing devices 50Y, 50M, 50C and 50K accommodate liquid developers containing toner particles which develop the colors of yellow (Y), magenta (M), cyan (C) and black (K), respectively. Further, the developing devices 50Y, 50M, 50C and 50K have functions of developing electrostatic latent images formed on the photosensitive members 20Y, 20M, 20C and 20K, by the respective liquid developers.

Incidentally, the four image forming portions 1Y, 1M, 1C and 1K have the substantially same constitution except that development colors are different from each other. Accordingly, in the following, the image forming portion 1K will be described as a representative with use of FIG. 2, and other image forming portions will be omitted from description. Incidentally, as regards reference numerals or symbols of respective portions in FIG. 1, the portions are represented by adding suffixes (Y, M, C, K) corresponding to the respective colors to the reference numerals or symbols.

At a periphery of the photosensitive member 20K, along a rotational direction thereof, a charging device 30K for electrically charging the photosensitive member 20K, an exposure device 40K for forming the electrostatic latent image on the charged photosensitive member 20K, the developing device 50K, a cleaning device 21K and the like are provided.

The photosensitive member 20K is a photosensitive drum formed in a cylindrical shape and includes a cylindrical base material and a photosensitive layer formed on an outer peripheral surface of the base material, and is rotatable about a center axis thereof. The photosensitive member 20K is constituted by an organic photosensitive member or an amorphous silicon photosensitive member. In this embodiment, as regards the photosensitive member 20K, the photosensitive layer was formed by a mixture of amorphous silicon and amorphous carbon, and a diameter was 84 mm. The photosensitive member 20K is capable of carrying the electrostatic latent image described below. In this embodiment, the photosensitive member 20K rotates in the counterclockwise direction as shown by an arrow in FIG. 2.

The charging device 30K is a device for electrically charging the photosensitive member 20K. In this embodiment, a corona charger is used as the charging device 30K. The charging device 30K is provided upstream of a nip between the photosensitive member 20K and a developing roller 54 described later, and a bias of the same polarity as a charge polarity of the toner is applied to the charging device 30K from an unshown power (voltage) source, and thus the photosensitive member 20K is electrically charged. In this embodiment, the surface of the photosensitive member 20K is electrically charged to −500 V by applying a voltage of about −4.5 kV to −5.5 kV to a charging wire of the charging device 30K.

The exposure device 40K includes a semiconductor laser, a polygon mirror, an F-θ lens and the like, and the charged photosensitive member 20K is irradiated with laser light modulated correspondingly to the image signal, so that the electrostatic latent image is formed on the photosensitive member 20K. That is, the electrostatic latent image is carried on the photosensitive member 20K. In this embodiment, the electrostatic latent image is formed on the surface of the photosensitive member 20K so that an image portion potential is made about −100 V by the exposure device 40K.

The developing device 50K is a device for developing the electrostatic latent image, formed on the photosensitive member 20K, with the toner of black (K). Details of the developing device 50K will be described later. The toner image formed on the photosensitive member 20K is primary-transferred onto the intermediary transfer belt 70 by applying a transfer voltage between the primary transfer roller 61K and the photosensitive member 20K. The cleaning device 21K includes a cleaning blade 21Ka and a collecting portion 21Kb and is capable of collecting the liquid developer on the photosensitive member 20K after the primary transfer.

Developing Device

Next, a structure of the developing device 50K in this embodiment will be described using FIG. 2. The developing device 50K includes a developing cartridge 50*a* and a developing (device) frame 50*b* (see FIG. 4 and the like) as a supporting member although details thereof will be described later. The developing cartridge 50*a* includes the developing roller 54 as a developer carrying member for carrying the liquid developer to the photosensitive member 20K. At a periphery of the developing roller 54, a developer container 53, a film forming electrode 51, a drawing roller 52 as a pressing member, and a cleaning roller 58 as a cleaning member are provided. The developing cartridge 50*a* includes a developing roller 54, a developer container 53, a film forming electrode 51, a drawing roller 52, a cleaning roller 58 and a developer collecting container 55 described later.

To the developing roller 54, the film forming electrode 51, the drawing roller 52 and the cleaning roller 58, voltages are applied from voltage sources, respectively, described later. Then, depending on potential differences between the voltages applied to the respective members, toner particles in the liquid developer move in desired directions by electrophoresis. Incidentally, all the voltages applied to the respective members comprising the developing roller 54, the film forming electrode 51, the drawing roller 52 and the cleaning roller 58 are negative voltages.

The developing roller 54 rotates while carrying the liquid developer containing the toner and the carrier, and develops, with the toner at a developing position opposing the photosensitive member 20K, the electrostatic latent image carried on the photosensitive member 20K. The developing roller 54 is a cylindrical member of 42 mm in diameter and rotates about a center axis thereof in the clockwise direction indicated by an arrow P in FIG. 2. Specifically, the developing roller 54 includes a core metal of stainless steel, and on an outer peripheral surface of the core metal, a 5 mm-thick elastic layer of an electroconductive polymer is formed.

A surface layer member of the developing roller 54 is an electroconductive elastic layer in which as an electric resistance adjusting material, electroconductive fine particles are mixed and dispersed in a resin material. As the resin material, it is possible to cite EPDM, urethane, silicone, nitrile-butadiene rubber, styrene-butadiene rubber and butadiene rubber. Further, as the surface layer member, it is possible to cite a member comprising a base material comprising a dispersion-type resistance adjusting resin material in which as the electric resistance adjusting resin material, electroconductive fine particles, for example, either one or a plurality of carbon black and titanium oxide are dispersed and mixed in a resin material selected from the above-described resin materials. Or, as the surface layer member, it is possible to cite a member using, as a base material, an electric resistance adjusting resin material in which an ion conductive material, for example, either one or a plurality of inorganic ion conductive materials such as sodium perchlorate, calcium perchlorate and sodium chlorate are used in the above-described resin material.

As regards the surface layer member, volume resistivity is adjusted to $1\times10^{2}$-$1\times10^{12}$ Ω·cm inclusive of variation. Further, in the case where a foaming agent is used in a foaming and mixing step for obtaining elasticity, a silicone-based surfactant (polydiallylsiloxane, polysiloxane-polyalkylene-oxide block copolymer) is suitable. In this embodiment, the surface layer of the developing roller 54 is an electroconductive urethane rubber, and inside the surface layer of the developing roller 54, the ion-conductive agent is uniformly dispersed, so that the volume resistivity is adjusted to $1\times10^{5}$-$1\times10^{7}$ Ω·cm in an initial state.

The developer container 53 stores the liquid developer in which the toner particles of black are dispersed in the carrier liquid. The liquid developer used in this embodiment is prepared by adding the particles, in which a colorant such as a pigment is dispersed principally in a polyester-based resin material and which are of 0.7 μm in average particle size, together with a dispersant, a toner charge control agent and a charge-directing agent into the liquid carrier such as an organic solvent. Further, in this embodiment, the surfaces of the toner particles are charged to a negative polarity in a certain amount. Incidentally, specific gravity of the toner particles and specific gravity of the carrier liquid are 1.35 g/cm$^3$ and 0.83 g/cm$^3$, respectively. A movement amount and a pressing amount of the toner particles and controlled by adjusting the potential differences between the respective members.

Further, the developer container 53 is capable of supplying the stored liquid developer to the developing roller 54. That is, the developer container 53 accommodates the liquid developer, for developing the electrostatic latent image formed on the photosensitive member 20K, in order to be supplied to the developing roller 54.

The liquid developer stored in the developer container 53 is supplied from a mixer 59K. To the mixer 59K, the carrier liquid and the toner are supplied appropriately from a carrier tank storing a carrier liquid for supply and a toner tank storing toner for supply, respectively, for example. In the mixer 59K, a stirring blade driven by an unshown motor is accommodated and mixes the supplied carrier liquid and the supplied toner with each other by stirring thereof, and thus disperses the toner in the carrier liquid.

In the mixer 59K, a toner particle concentration (toner concentration, T/D) of the liquid developer is appropriately adjusted. Incidentally, the toner concentration is a weight percentage concentration (wt. %) of the toner particles in the liquid developer. In this embodiment, the liquid developer adjusted in the mixer 59K so that T/D is 3.5±0.5 wt. % is supplied to the developer container 53 from a developer supplying opening 531 connected with the mixer 59K.

Incidentally, the developer container 53 is provided with guiding member 533 forming a flushing flow path 57 and with a developer discharging hole 532. The liquid developer in the developer container 53 leaks out thereof from the developer discharging hole 532 provided at the bottom of the developer container 53, and is collected in a developer collecting container 55. For this reason, in the case where supply of the liquid developer to the developer container 53 during a stop of the image forming operation or the like, an amount of the liquid developer accommodated in the developer container 53 gradually decreases, and finally, the developer container 53 becomes empty.

Here, flushing is such that the liquid developer which was supplied to the developer container 53 and which is in a state in which the T/D is low is caused to flow between a contact portion of the cleaning roller 58 with a cleaning blade 56 and a nip between the developing roller 54 and the cleaning roller 58. The liquid developer collected by the cleaning roller 58 is high in concentration of toner particles contained in the liquid developer (i.e., T/D) in some cases. In the case where the T/D of the liquid developer is high, apparent viscosity of the liquid developer becomes high, and in the case where the liquid developer high in apparent viscosity is scraped off by the cleaning blade 56, the liquid developer which is scraped off does not readily flow toward the developer collecting container 55 along the inclination of the surface of the cleaning blade 56. As a result of this, the toner particles are liable to stagnate at a free end portion, a surface-stepped portion and the like of the cleaning blade 56. For this reason, the flushing such that the liquid developer which was supplied to the developer container 53 and which is in the state in which the T/D is low (3.5±0.5 wt. % in this embodiment) is caused to flow toward the cleaning roller 58 is performed. By this, the stagnation of the toner particles due to the increase in T/D as described above can be alleviated.

Figure 3:
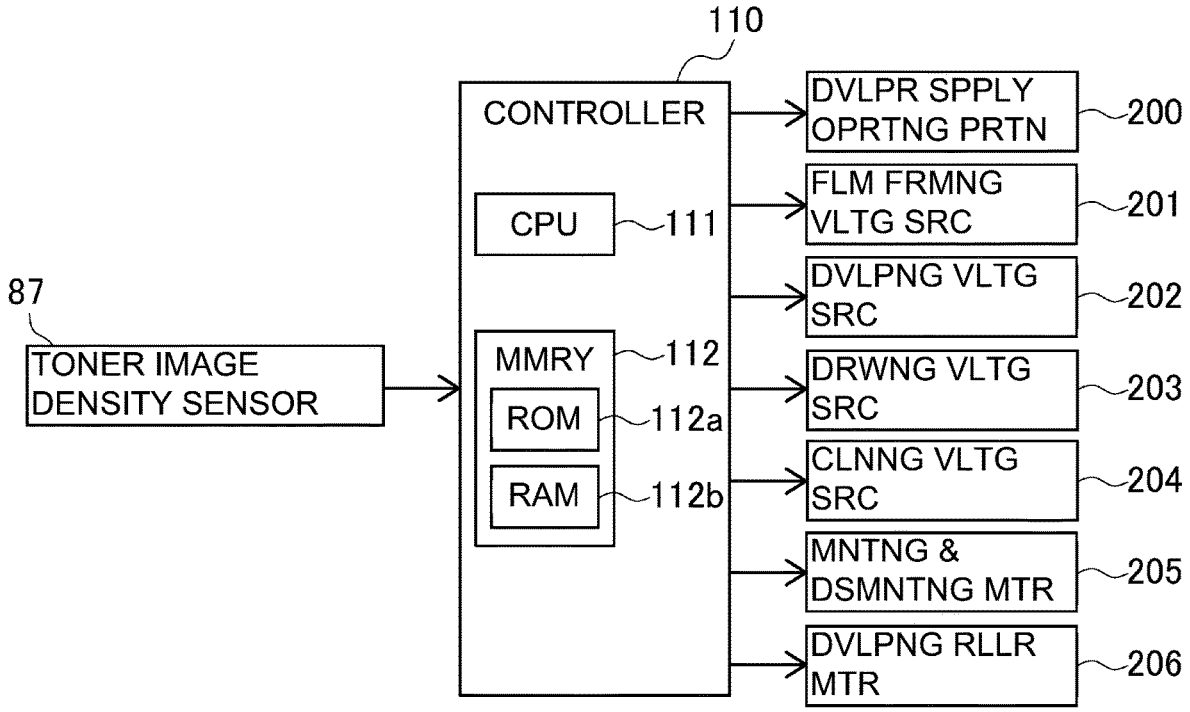
FIG. 3 is a control block diagram of the image forming apparatus according to the embodiment.

The film forming electrode 51 causes the developing roller 54 to carry thereon the liquid developer from the developer container 53 and attracts the toner particles toward the developing roller 54 side by the action of an electric field. That is, the film forming electrode 51 is disposed opposed to the developing roller 54 at a position upstream of the developing position with respect to the rotational direction of the developing roller 54 with a predetermined gap from the developing roller 54. Further, the film forming electrode 51 forms a film of the liquid developer, on the developing roller 54, supplied from the developer container 53 so as to provide a desired toner concentration by being supplied with a predetermined film forming voltage from a film forming power (voltage) source 201 (FIG. 3).

Specifically, the film forming electrode 51 is 24 mm in circumferential length of a surface opposing the developing roller 54 and forms a gap (predetermined gap) of 400±100 μm with the developing roller 54. The liquid developer supplied to the developer container 53 is drawn into the gap between the film forming electrode 51 and the developing roller 54 by rotation of the developing roller 54 as shown by arrows A and D of FIG. 2. Then, by a difference in applied voltage between the film forming electrode 51 and the developing roller 54, the toner particles are drawn toward the developing roller 54 side by the electric field generated in the predetermined gap.

The drawing roller 52 is provided downstream of the film forming electrode 51 and upstream of the developing position with respect to the rotational direction of the developing roller 54, and presses, against the developing roller 54, the toner in the liquid developer formed in the film on the developing roller 54 (on a developer carrying member). That is, the drawing roller 52 shifts the toner particles, contained in the liquid developer formed in the film on the developing roller 54, toward the developing roller 54 side under application of a predetermined drawing voltage from a drawing power (voltage) source 203 (FIG. 3), and at the same time, draws and collects an excessive carrier liquid.

Such a drawing roller 52 is a cylindrical member formed of metal, and in this embodiment, a roller formed of stainless steel in a diameter of 16 mm is used as the drawing roller 52. The drawing roller 52 is contacted to the developing roller 54 so that pressure is constant (35±5 N in this embodiment) over a longitudinal direction (rotational axis direction of the developing roller 54, 354 mm in this embodiment). Further, the drawing roller 52 rotates in the counterclockwise direction as shown in FIG. 2.

The liquid developer raised from the developer container 53 and passed through the film forming electrode 51 is carried in a certain amount on the developing roller 54 in the direction of arrow B. For that reason, as shown in FIG. 2, of the liquid developer conveyed at a predetermined speed to a contact portion between the drawing roller 52 and the developing roller 54, a portion existing on the surface of the developing roller 54 stably forms a nip between the drawing roller 52 and the developing roller 54. In this embodiment, the gap in the nip is about 6 μm, and a width of the nip with respect to the rotational direction is about 3 mm.

In this nip, by the electric field generated by the difference in applied voltage between the drawing roller 52 and the developing roller 54, the toner particles are pressed toward the developing roller 54 side. In the neighborhood of an outlet between the drawing roller 52 and the developing roller 54, the liquid developer is separated into those on the respective roller surfaces, and the respective liquid developers are carried on the rollers, respectively. At this time, almost all the toner particles and the carrier liquid are carried on the developing roller 54 side, and only the carrier liquid is carried on the drawing roller 52 side. For this reason, T/D of the liquid developer line formed on the developing roller 54 is 10 times or more higher compared with T/D of the liquid developer in the developer container 53. Incidentally, in this embodiment, T/D in the developer liquid of the surface of the developing roller 54 after passing through the nip is 50±5 wt. %.

Figure 2:
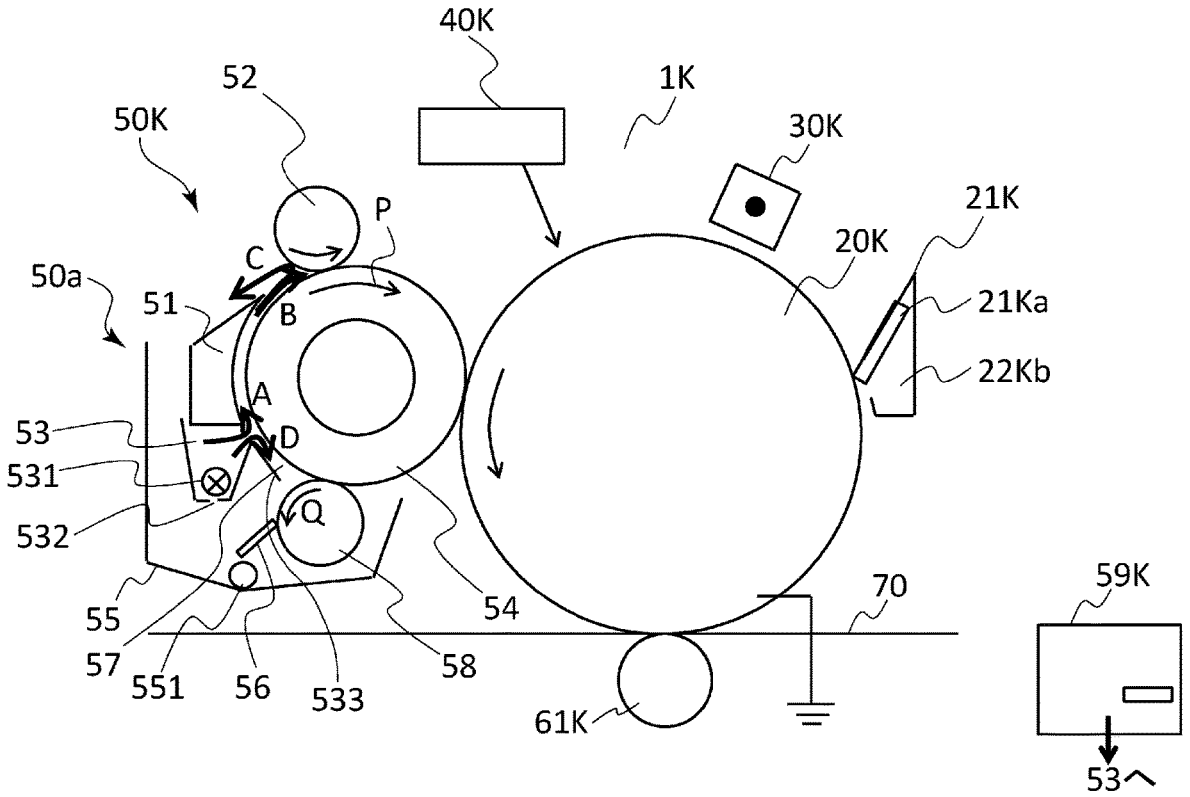
FIG. 2 is a schematic structural view of an image forming portion according to the embodiment.

On the other hand, the liquid developer which passed through the gap between the film forming electrode 51 and the developing roller 54 and which thereafter does not enter the gap between the drawing roller 52 and the developing roller 54 is repelled by the drawing roller 52 as shown by an arrow C of FIG. 2. Then, the liquid developer is caused to flow on a back surface of the film forming electrode 51 and is collected in the developer collected container 55.

The cleaning roller 58 collects the toner particles on the developing roller 54 which do not contribute to image formation at the developing position, by the action of the electric field. That is, the development cleaning roller 58 is provided at a cleaning position downstream of the developing position with respect to the rotational direction of the developing roller 54, and removes the toner, which passes through the developing position and which remains on the developing roller 54, under application of a cleaning voltage from a cleaning power (voltage) source 204. Specifically, the cleaning roller 58 rotates while removing the liquid developer on the developing roller 54 by an electric field generated by an applied voltage difference between itself and the developing roller 54. The cleaning roller 58 is contacted to the surface of the developing roller 54 and rotates in the counterclockwise direction shown by an arrow Q in FIG. 2, and is a roller formed of stainless steel or aluminum, for example. In this embodiment, as the cleaning roller 58, a roller formed of the stainless steel in a diameter of 16 mm is used.

The toner collected by the cleaning roller 58 is removed by a cleaning blade 56 as a cleaning blade. The cleaning blade 56 is provided, with respect to the rotational direction of the cleaning roller 58, at a contact position on a side downstream of a position (cleaning position) opposing the developing roller 54 so as to contact the cleaning roller 58. Then, the cleaning roller 58 from which the developer is removed by the cleaning blade 56 performs removal of the liquid developer from the developing roller 54 again. The cleaning blade 56 is a blade which is formed of stainless steel and which is 0.1 mm in thickness and 8 mm in free length. The cleaning blade 56 is contacted counterdirectionally to the cleaning roller 58.

The liquid developer collected from the developing roller 54 to the cleaning roller 58 and the liquid developer supplied to the cleaning roller 58 by the flushing are scraped off by the cleaning blade 56 and are collected in the developer collecting container 55. The liquid developer collected in the developer collecting container 55 is discharged through a developer discharge opening 551 and passes through an unshown circulating path, and is supplied again toward the mixer 59K.

In this embodiment, an image forming process speed if 785 mm/s, and the above-described respective rollers contributing to the image formation rotate so that respective surface peripheral speeds are 785 mm/s.

Control of Image Forming Apparatus

Next, a constitution of a control system in the above-described image forming apparatus 100 will be described using FIG. 3. In a controller 110, a CPU (Central Processing Unit: central processing unit) 111 is provided. Further, in a memory 112, ROM (Read Only Memory) 112*a* is provided. In the ROM 112*a*, a program corresponding to a control procedure is stored. The CPU 111 controls respective portions while reading data and programs written in advance in the ROM 112*a*. In the memory 112, also RAM (Random Access Memory) 112*b* in which operation data and input data read from respective sensors are stored is provided. The CPU 111 effects control by making reference to the data stored in the RAM 112*b* on the basis of the above-described programs or the like.

Further, the CPU 111 is also connected with a toner image density sensor 87. The CPU 111 adjusts, for example, a voltage applied to the film forming electrode 51 on the basis of a detecting result of the toner image density sensor 87. Further, the CPU 111 is connected with, as destination of control, a developer supply operation portion 200, a film forming voltage source 201, a developing voltage source 202, a drawing voltage source 203, a cleaning voltage source 204, a development mounting and dismounting motor 205, a developing roller motor 206 and the like. The developer supply operation portion 200 is, for example, a valve, a pump and the like and supplies the liquid developer to the developer container 53 by an instruction from the CPU 111.

The film forming voltage source 201, the developing voltage source 202, the drawing voltage source 203 and the cleaning voltage source 204 are capable of variably applying voltages to the film forming electrode 51, the developing roller 54, the drawing roller 52 and the cleaning roller 58, respectively. The development mounting and dismounting motor 205 causes the developing device 50K as described later, so that the developing roller 54 is contacted to and separated from the photosensitive member 20K. A developing roller motor 206 rotationally drives the developing roller 54. Incidentally, the above constitutions are ditto for the developing devices 50Y, 50M and 50C.

Image Forming Operation

An image forming operation of the image forming apparatus 100 will be described. Incidentally, also in the following, description will be made using the image forming portion 1K, but is ditto for other image forming portions. The liquid developer containing a toner particle layer carried on the developing roller 54 forms a visible image in the developing position which is an opposing portion between the developing roller 54 and the photosensitive member 20K, by following the latent image drawn (formed) on the photosensitive member 20K as specifically described in the following.

As described above, the electrostatic latent image formed on the photosensitive member 20K on a side upstream of the developing position is developed with the toner particles in the developing position and becomes the visible image. In the developing position, from the developing voltage source 202 to the developing roller 54, a developing bias of about −300 V is applied in this embodiment. By this, in accordance with an electric field formed by the electrostatic latent image (image portion: −100 V, non-image portion: −500 V) on the photosensitive member 20K, at the image portion, the toner particles move onto the photosensitive member 20K by electrophoresis. On the other hand, at the non-image portion, the electric field acts in a direction in which the toner particles are pressed against the developing roller 54, and therefore, the toner particles remain on the developing roller 54 as they are. By this, the visible image with the toner particles is formed on the photosensitive member 20K.

The toner particles moved onto the photosensitive member 20K at the developing position is subjected to an image forming process on a downstream side and are primary-transferred onto the intermediary transfer belt 70. At the primary transfer portion, the photosensitive member 20K and the intermediary transfer belt 70 oppose each other, and to the back surface of the intermediary transfer belt 70, a primary transfer roller 61K is contacted. To the primary transfer roller 61K, a voltage of an opposite polarity (+200 to +300 V in this embodiment) to the charge polarity of the toner particles is applied, so that the toner image formed on the photosensitive member 20K moves onto the intermediary transfer belt 70 by electrophoresis. On the photosensitive member 20K, the carrier liquid and the toner in a slight amount of about several % remain, but are scraped off by the cleaning device 21K disposed on a side downstream of the primary transfer portion T1K.

On the other hand, the toner particles remaining on the developing roller 54 go to a collecting and re-using process. That is, on the developing roller 54, the cleaning roller 58 is contacted on a side downstream of the developing position. In a nip between the developing roller 54 and the cleaning roller 58, an electric field is generated by a difference between voltages applied from the developing voltage source 202 and the cleaning voltage source 204 to the developing roller 54 and the cleaning roller 58, respectively. The toner particles on the developing roller 54 which do not contribute to the image formation in the developing position enter the nip, and almost all the toner particles move toward the surface of the cleaning roller 58 by electrophoresis.

To the cleaning roller 58, the cleaning blade 56 is contacted. The liquid developer containing the toner particles collected from the developing roller 54 to the surface of the cleaning roller 58 is scraped off at a contact position between a free end of the cleaning blade 56 and the cleaning roller 58 and flows toward the developer collecting container 55 along inclination of the cleaning blade 56.

In this embodiment, when the image formation is carried out, supply of the liquid developer from the mixer 59K toward the developer container 53 is continuously performed. At that time, the supplied liquid developer moves between the film forming electrode 51 and the developing roller 54 and is carried on the developing roller 54. Or, the liquid developer moves toward the flushing flow path 57 and contributes to flushing on the cleaning roller 58.

Further, a part of the liquid developer supplied toward the developer container 53 is leaked out from the developer container 53 to the developer collecting container 55 through the developer discharge opening 532. When the supply of the liquid developer toward the developer container 53 is stopped, there is no supply of the liquid developer onto the developing roller 54 and the flushing flow path 57, and thereafter, the liquid developer is gradually leaked out through the developer discharge opening 532, so that the inside of the developer container 53 finally becomes empty.

Further, during the image forming operation, voltages are applied to the developing roller 54, the film forming electrode 51, the drawing roller 52 and the cleaning roller 58, respectively, and provide a driving force for electrophoresis of the toner particles. In this embodiment, the voltages applied to the developing roller 54, the drawing roller 52 and the cleaning roller 58 are −300 V, −370 V and −150 V, respectively. The voltage applied to the film forming electrode 51 is controlled by the image density detected by a toner image density sensor 87 provided on the intermediary transfer belt 70. This is due to that mobility (moving speed relative to electric field intensity) of the toner particles in the liquid developer contributing to the image formation changes depending on a consumption status or the like of the toner particles. Incidentally, in a typical situation, the voltage applied to the film forming electrode 51 is −600 to −900 V.

Here, the developing cartridge 50*a* including the developing roller 54 operates so that the developing roller 54 is contacted to and separated from the photosensitive member 20K in a direction of the photosensitive member 20K by the development mounting and dismounting motor 205. In this embodiment, during the image forming operation, the developing roller 54 and the photosensitive member 20K contact each other with a contact pressure of 80±10 N. Before and after the image forming operation, the respective operations of the developing roller 54 and the photosensitive member 20K are stopped in a separated state. Incidentally, these operations are ditto for the developing devices 50Y, 50M and 50C.

Further, the developing roller 54, the drawing roller 52 and the cleaning roller 58 rotate at a substantially the same surface peripheral speeds, respectively, during the image formation. A driving force for rotation is given to the developing roller 54 by the developing roller motor 206, and the driving force is divided from the developing roller 54 into the drawing roller 52 and the cleaning roller 58 via gears. For this reason, in this embodiment, these three rollers simultaneously start and stop their rotating operations.

Figure 4:
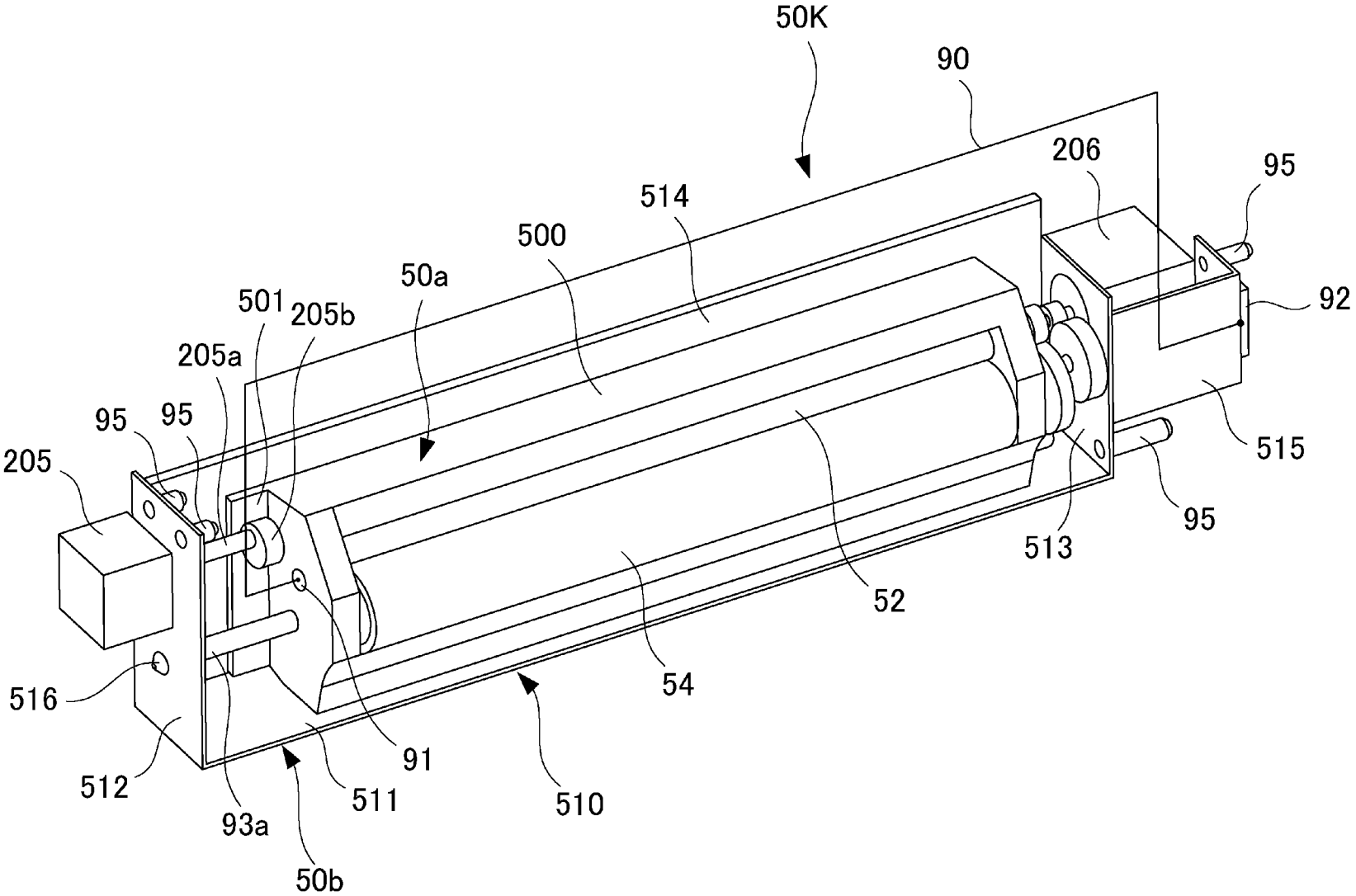
FIG. 4 is a perspective view of a developing device according to the embodiment.

Next, the developing cartridge 50*a* and the developing frame 50*b* as the supporting member which constitute the above-described developing device 50K will be described using FIG. 4 to FIG. 9. Incidentally, the developing devices 50Y, 50M and 50C are also similar to the developing device 50K. As shown in FIG. 4, the developing device 50K includes the developing cartridge 50*a* and the developing frame 50*b*. Such a developing device 50K is mountable to and dismountable from an apparatus main assembly 100A (see FIG. 8) of the image forming apparatus 100.

As described above, in the case of the constitution in which the developing device is mountable to and dismountable from the apparatus main assembly, the case where the driving source such as the developing roller motor is provided in the developing device and the case where the driving source is provided on the apparatus main assembly side exist. Here, in the case where the developing device is provided with the driving source, when the developing roller which is the consumable part is periodically exchanged, the driving source is exchanged together with the developing device even if the driving source is not out of order, so that the running cost increases.

Further, in this constitution, it would be considered that only the developing roller is exchanged and the driving source and the like are utilized again, but an operation in which the developing device is disassembled and then is assembled again occurs. Particularly, in the case of the developing device of the wet developing type as in this embodiment, the developing device includes a component part for ensuring a sealing property of the liquid, and therefore, there is a liability that the sealing property is impaired during such a disassembling and re-assembling operation. On the other hand, in the constitution in which the driving source is provided on the apparatus main assembly side, a driving source exchanging operation is not readily performed in the case where the driving source is out of order, so that the maintenance property is low.

Therefore, in this embodiment, the developing device is constituted in the following manner so as to suppress a lowering in performance due to the exchanging operation of the consumable part of the developing device, an increase in running cost, and a lowering in maintenance property.

In this embodiment, the developing device 50K is constituted by the developing cartridge 50*a* including the developing roller 54 and the like and by the developing frame 50*b* as the supporting member including the driving source such as the developing roller motor 206. Further, the developing cartridge 50*a* is mode mountable to and dismountable from the developing frame 50*b*, and the developing frame 50*b* is made mountable to and dismountable from the apparatus main assembly 100A. That is, a constitution in which the developing device 50K is mountable to and dismountable from the apparatus main assembly 100A is employed, and the developing cartridge 50*a* and the developing frame 50*b* which constitute the developing device 50K are made separable from each other. In the following, the developing cartridge 50*a* and the developing frame 50*b* in this embodiment will be described in detail.

Figure 5:
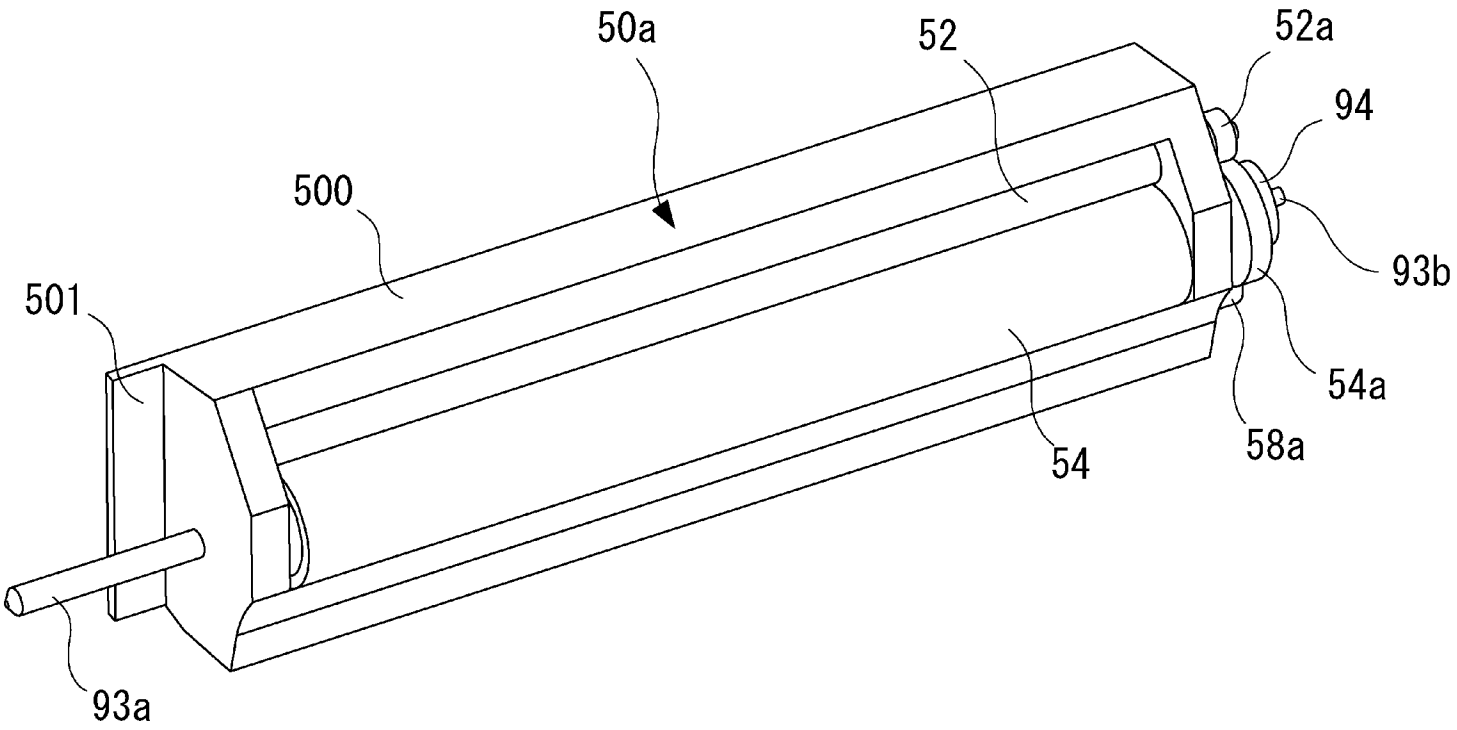
FIG. 5 is a perspective view of a developing cartridge according to the embodiment.

The developing cartridge 50*a* is, as shown in FIG. 5, prepared by arranging the developing roller 54, the drawing roller 52 and the like in the developer container 500. The developer container 500 includes the developer collecting container 55 at a lower portion thereof, and in the developer container 500, the developer container 53, the film forming electrode 51, the cleaning roller 58 and the like are also disposed. In this embodiment, the developing cartridge 50*a* is constituted by these members.

On opposite end surfaces of the developer container 500 with respect to a longitudinal direction (rotational axis direction of the developing roller 54), swing shafts 93*a* and 93*b* projecting in the longitudinal direction are provided. The swing shafts 93*a* and 93*b* are coaxially provided at positions deviated from a center shaft of the developing roller 54. Further, on an end surface side of one side (left side of FIG. 5) of the developer container 500 with respect to the longitudinal direction, at a portion opposite from a side where the developing roller 54 is provided, a projected plate portion 501 projecting in the longitudinal direction is provided. On the other hand, on the shaft (swing shaft) of the swing shaft 93*b* projecting from the other side (right side of FIG. 5) of the developer container 500 with respect to the longitudinal direction, an idler gear 94 as a rotation transmission member is rotatably supported.

Incidentally, one side with respect to the longitudinal direction referred to in this embodiment is a front side which is a side where a user operates the image forming apparatus 100 in an installation state of the image forming apparatus 100, and the other side with respect to the longitudinal direction is a rear (surface) side of the image forming apparatus 100 opposite from the front side.

On an end surface of the developer container 500 on the other side with respect to the longitudinal direction, a plurality of gears 52*a*, 54*a* and 58*a* are provided. The gear 52*a* is fixed to a rotation shaft of the drawing roller 52, the gear 54*a* is fixed to a rotation shaft of the developing roller 54, and the gear 58*a* is fixed to a rotation shaft of the cleaning roller 58, respectively. The idler gear 94 is, as specifically described later, engaged with the gear 54*a*, and the gears 52*a* and 58*a* are engaged with the gear 54*a*.

Figure 6:
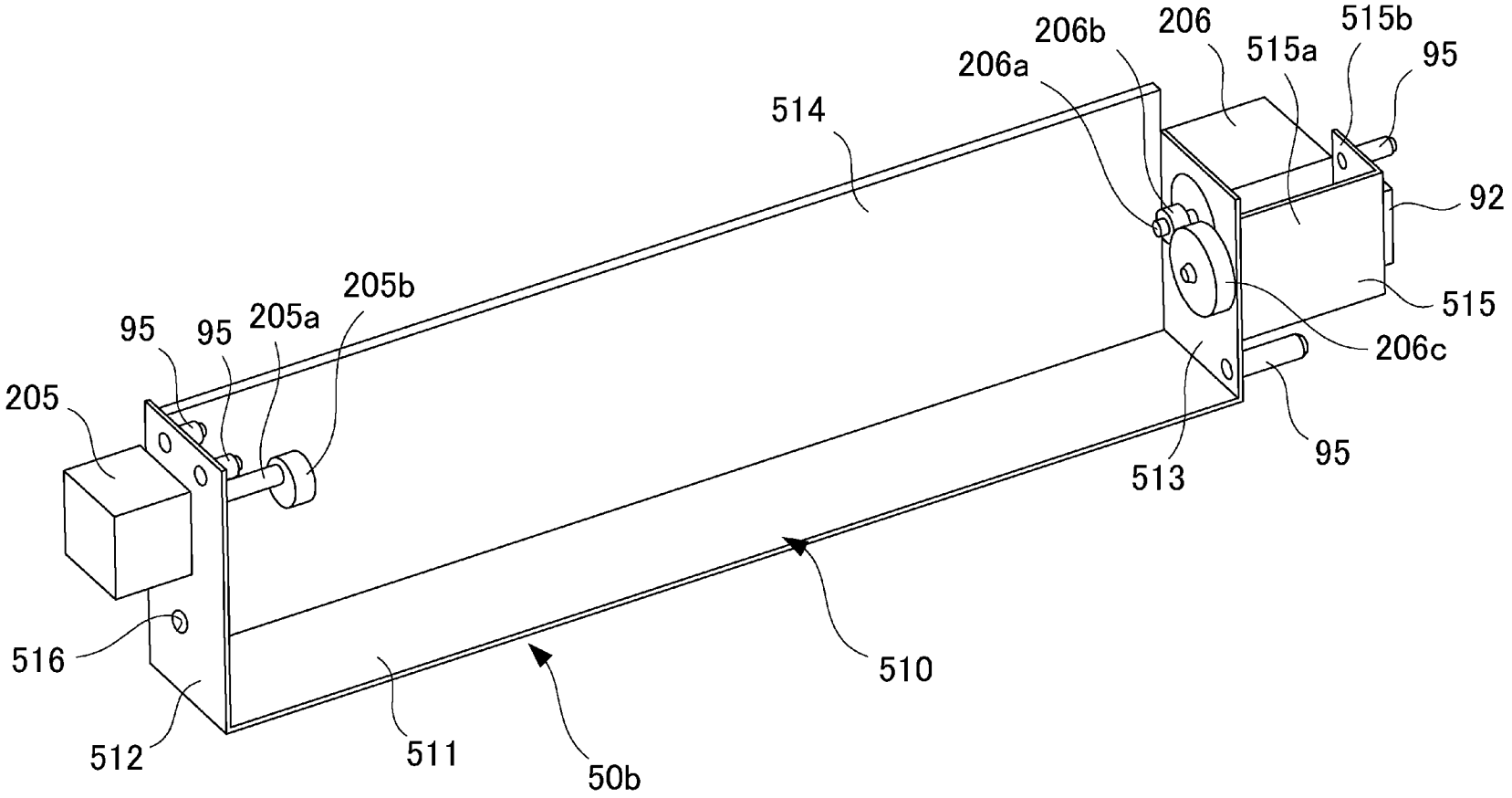
FIG. 6 is a perspective view of a developing (device) frame according to the embodiment.

The developing frame 50*b* includes, as shown in FIG. 6, a frame 510, a developing (roller) contact and separation motor 205 as a swing driving source, a developing roller motor 206 and a driving source, an input drawer 92 and the like. The frame 510 is constituted by a bottom plate portion 511, a first side wall 512, a second side wall 513 and a supporting wall 514. The first side wall 512 and the second side wall 513 are formed so as to project upward from opposite end portions of the bottom plate portion 511 with respect to the longitudinal direction (rotational axis direction of the developing roller 54). The supporting wall 514 is formed so as to project from an end portion of the bottom plate portion 511 on a side opposite from the side where the developing roller 54 is provided in the case where the developing cartridge 50*a* is mounted. In a space surrounded by these bottom plate portion 511, first side wall 512, second side wall 513 and supporting wall 514, the developing cartridge 50*a* is disposed.

On an outside surface of the first side wall 512 of one side (left side of FIG. 6) of the frame 510 with respect to the longitudinal direction, the developing contact and separation motor 205 is supported. A rotation shaft 205*a* of the developing contact and separation motor 205 penetrates through the first side wall 512 and projects toward an inside of the first side wall 512, and to an end portion thereof, a cam 205*b* is fixed.

On an outside surface of the second side wall 513 on the other side (right side of FIG. 6) of the frame 510 with respect to the longitudinal direction, the developing roller motor 206 is supported. A rotation shaft 206*a* of the developing roller motor 206 penetrates through the second side wall 513 and projects towards an inside of the second side wall 513, and to an end portion thereof, a driving gear 206*b* is fixed. Further, on an inside surface of the second side wall 513, a reduction gear 206*c* engaging with the driving gear 206*b* is supported. The reduction gear 206*c* is to be engaged with the idler gear 94 on the developing cartridge 50*a* side as specifically described later.

Further, to the outside surface of the second side wall 513 a supporting member 515 is fixed. The supporting member 515 is constituted by a projected portion 515*a* projecting from the second side wall 513 in the longitudinal direction, and a supporting plate portion 515*b* provided at a free end of the projected portion 515*a* so as to extend in a direction perpendicular to the longitudinal direction. On an outside surface of the supporting plate portion 515*b*, i.e., on a surface of the supporting plate portion 515*b* on the other side with respect to the longitudinal direction, the input drawer 92 is provided.

The developing frame 50*b* is, as specifically described later, mountable to and dismountable from the apparatus main assembly 100A (see FIG. 8) of the image forming apparatus 100. For this reason, the developing frame 50*b* includes a plurality of positioning projects 95. Specifically, two positioning projects 95, one positioning project 95 and one positioning project 95 are provided on the inside surface of the first side wall 512, the outside surface of the second side wall 513 and the outside surface of the supporting plate portion 515*b*, respectively, so as to project toward the other side with respect to the longitudinal direction. Incidentally, the number and positions of the positioning projects 95 are appropriately settable.

Further, the first side wall 512 and the second side wall 513 are provided with supporting holes 516 for supporting the swing shafts 93*a* and 93*b* of the developing cartridge 50*a*. Incidentally, in FIG. 6, the supporting hole 516 on the second side wall 513 side hides behind the reduction gear 206*c*.

The thus-constituted developing frame 50*b* is capable of mounting the developing cartridge 50*a* therein and is capable of dismounting the developing cartridge 50*a* therefrom, and as shown in FIG. 4, the developing cartridge 50*a* is mounted in the developing frame 50*b*. The developing cartridge 50*a* is mounted in the developing frame 50*b* by inserting the swing shafts 93*a* and 93*b* provided at the opposite end portions of the developing cartridge 50*a* with respect to the longitudinal direction into the supporting holes 516 formed in the first side wall 512 and the second side wall 513 of the developing frame 50*b*. In a mounted state, the developing cartridge 50*a* is supported so as to be swingable about the swing shafts 93*a* and 93*b* in an arrow α direction of FIG. 9 described later. Incidentally, as specifically described later, the developing cartridge 50*a* is urged by an urging spring 517 (see FIG. 9) provided on the developing frame 50*b*, so that the developing roller 54 contacts the photosensitive member 20K. By this, positioning of the developing cartridge 50*a* is realized.

Figure 7:
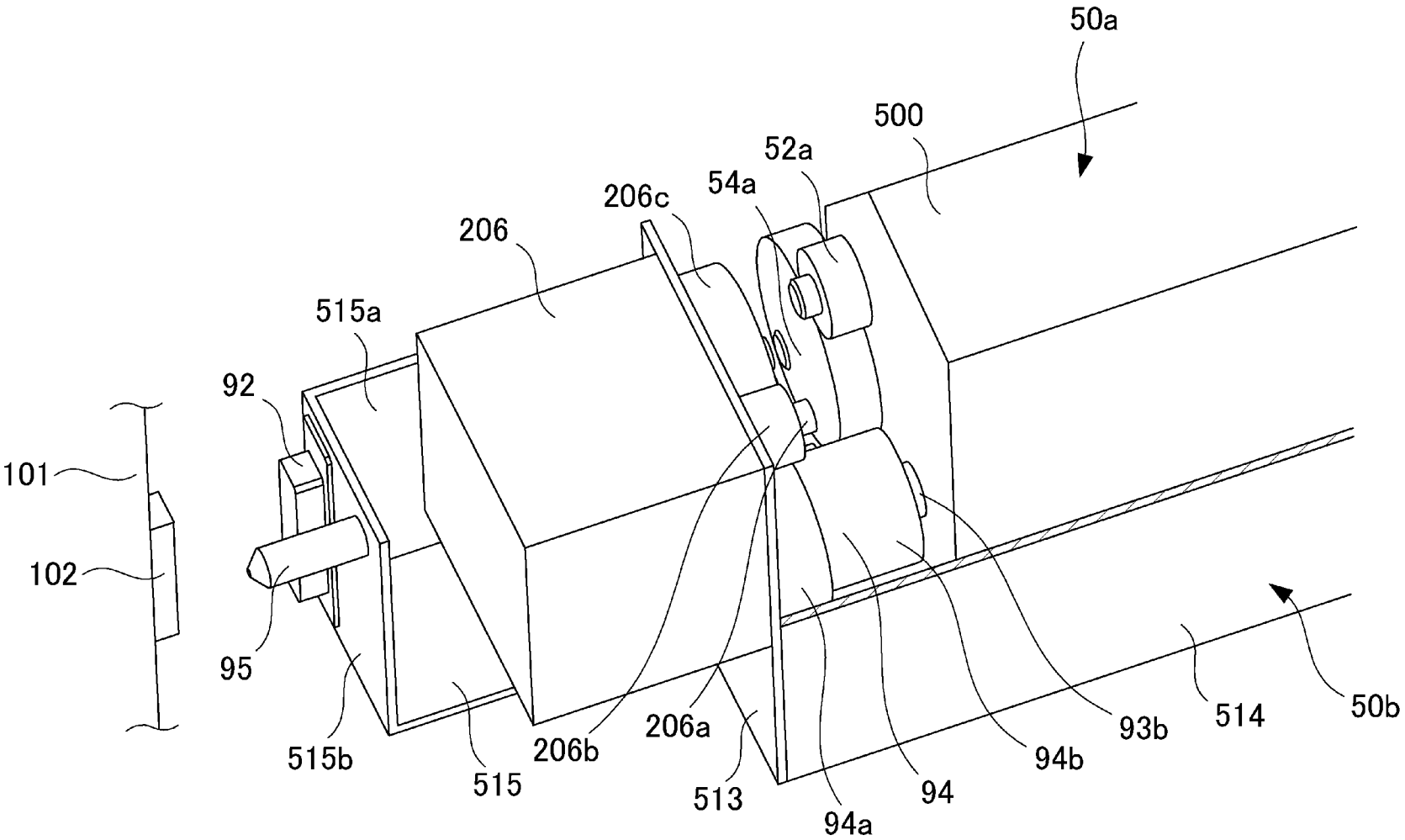
FIG. 7 is an enlarged perspective view on a developing roller motor side, in which a part of a supporting wall of the developing device according to the embodiment is cut and shown.

In a state in which the developing cartridge 50*a* is mounted in the developing frame 50*b*, as shown in FIG. 7, the idler gear 94 supported by the swing shaft 93*b* of the developing cartridge 50*a* and the reduction gear 206*c* supported by the developing frame 50*b* engage with each other. The idler gear 94 as the rotation transmission member is constituted by a first gear portion 94*a* engaging with the reduction gear 206*c* and a second gear portion 94*b* engaging with the gear 54*a*. Incidentally, FIG. 7 shows a part of the supporting wall 514 in a cut state for illustrating constitutions of these gears when the developing device 50K is seen from a side opposite from FIG. 4.

Thus, by engagement of the respective gears with each other, a driving force of the developing roller motor 206 is capable of being transmitted to the developing roller 54 and the like. First, the driving force of the developing roller motor 206 is transmitted from the driving gear 206*b* to the first gear portion 94*a* of the idler gear 94 via the reduction gear 206*c*. Then, the second gear portion 94*b* rotates together with the first gear portion 94*a*, so that the driving force is transmitted to the gear 54*a* and the developing roller 54 is rotated. The gear 54*a* engages with the gear 52*a* and the gear 58*a* (FIG. 5), and therefore, the driving force is transmitted from the gear 54*a* to the gears 52*a* and 58*a*, so that the drawing roller 52 and the cleaning roller 58 are rotated.

Further, as shown in FIG. 4, the cam 205*b* provided on the developing frame 50*b* opposes the projected plate portion 501 of the developing cartridge 50*a*. Further, as specifically described later, the cam 205*b* is rotationally driven by the developing contact and separation motor 205, so that the cam 205*b* presses the projected plate portion 501 and separates from the projected plate portion 501, and the developing cartridge 50*a* is swung.

Figure 8:
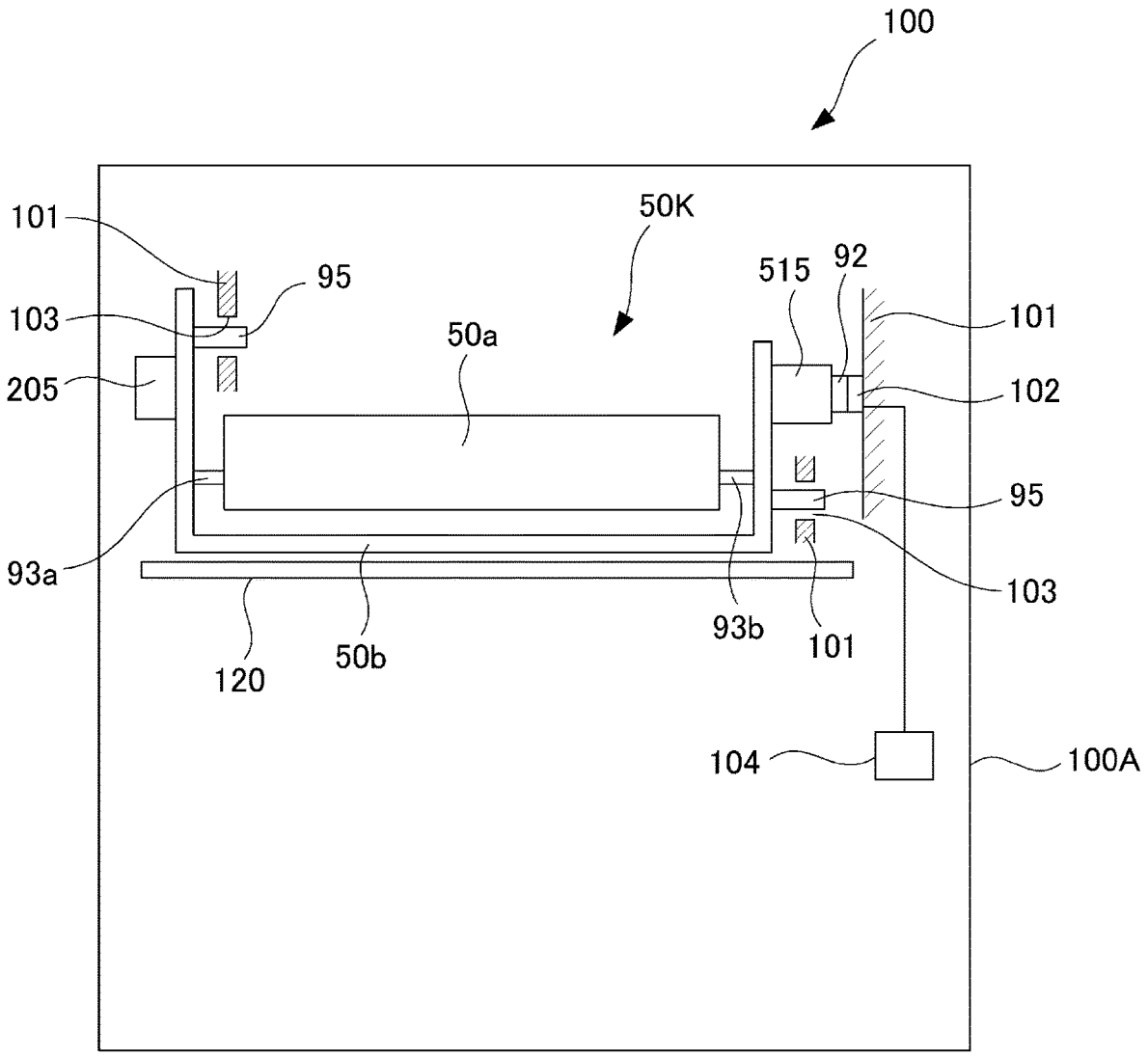
FIG. 8 is a schematic view showing a mounting state of the developing device according to the embodiment in an apparatus main assembly.

The developing frame 50*b* is mountable to and dismountable from the apparatus main assembly 100A. Specifically, as shown in FIG. 8, the apparatus main assembly 100A of the image forming apparatus 100 is provided with a rail 120 capable of being pulled toward the front side of the image forming apparatus 100. The rail 120 is movable in the longitudinal direction of the developing frame 50*b*. In the case where the developing frame 50*b* in which the developing cartridge 50*a* is mounted is mounted in the apparatus main assembly 100A, an unshown front door of the apparatus main assembly 100A is opened, and the rail 120 is pulled out. Then, the developing frame 50*b* is placed on the rail 120, and the rail 120 is pushed together with the developing frame 50*b* into the apparatus main assembly 100A. At this time, into positioning holes 103 formed in frames 101 provided on the front side and the rear side, respectively, in the apparatus main assembly 100A, the positioning projects 95 provided on the developing frame 50*b* are inserted, respectively, so that the developing frame 50*b* is positioned relative to the apparatus main assembly 100A.

Further, the rear-side frame 101 of the apparatus main assembly 100A is provided with an output drawer 102 as a first contact connected to a power source 104 of the apparatus main assembly 100A. The output drawer 102 is, as shown in FIG. 7, disposed at a position opposing the input drawer 92 as a second contact provided on the rear side of the developing frame 50*b* and is connectable with the input drawer 92. For this reason, when the developing frame 50*b* is pushed in during mounting of the developing frame 50*b* in the apparatus main assembly 100A as described above, by this pushing-in operation, as shown in FIG. 8, the input drawer 92 connects with the output drawer 102.

Incidentally, the power source 104 includes a power source capable of supply electric power to the developing roller motor 206 and power sources, such as a power source for film formation 201, a power (voltage) source for development 202 and a power source for drawing 203, supplying electric power to the developing device 50K.

To the input drawer 92, as shown in FIG. 4, a bundle wire 90 is connected. The bundle wire 90 is connectable to a contact 91 provided on the front side of the developing cartridge 50*a*. By this, the electric power of the power source 104 in the apparatus main assembly 100A is supplied to the developing cartridge 50*a* via the output drawer 102, the input drawer 92 and the bundle wire 90. Incidentally, the output drawer 102, the input drawer 92 and the bundle wire 90 also transmit signals, of various sensors provided in the developing device 50K, to the controller 110 of the apparatus main assembly 100A.

Incidentally, in this embodiment, in order to avoid the respective gears provided on the rear side, the contact 91 was provided on the front side of the developing cartridge 50*a*. However, the contact 91 may also be provided on the rear side of the developing cartridge 50*a*. In this case, for example, the contact on the developing frame 50*b* side is urged toward the developing cartridge 50*a* side, so that the contact on the developing frame 50*b* side may also be made easily connected to the contact on the developing cartridge 50*a* side.

Figure 9:
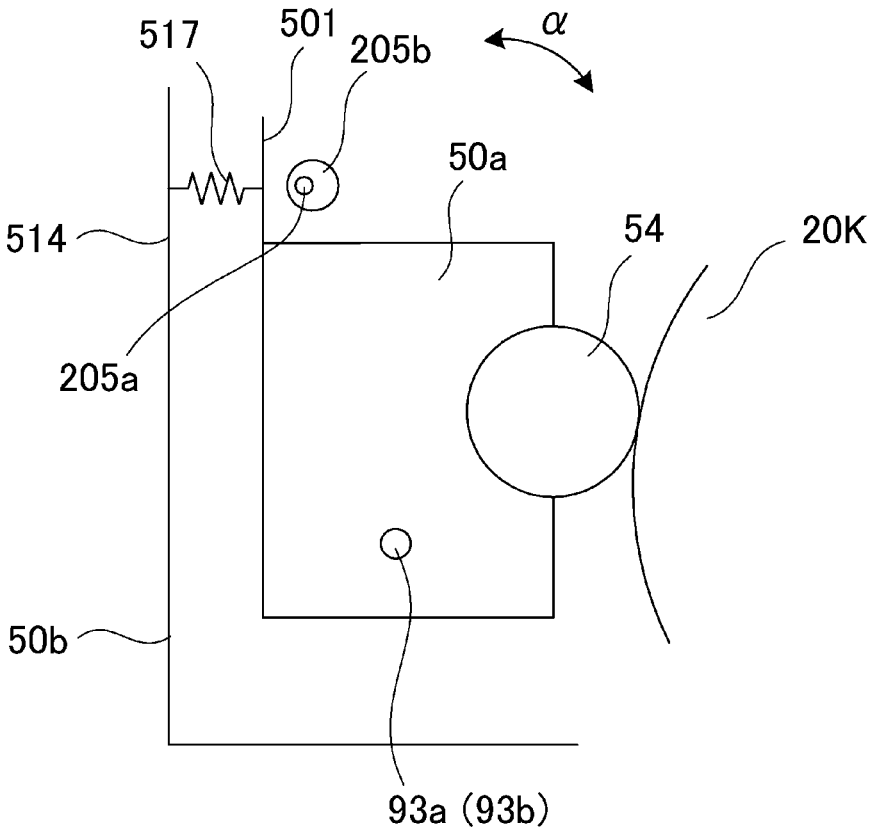
FIG. 9 is a schematic view for illustrating a swing device for the developing device according to the embodiment.

When the developing frame 50*b* in which the developing cartridge 50*a* is mounted is mounted in the apparatus main assembly 100A, a shown in FIG. 9, the developing roller 54 contacts the photosensitive member 20K. That is, the developing cartridge 50*a* including the developing roller 54 is supported so as to be swingable in the arrow α direction about the swing shafts 93*a* and 93*b* relative to the developing frame 50*b*. On the supporting wall 514 of the developing frame 50*b*, the urging spring 517 as an urging means is provided. The urging spring 517 is provided in an elastically compressed state between the supporting wall 514 and the projected plate portion 501, and urges the developing cartridge 50*a* in a predetermined direction (clockwise direction of FIG. 9) by an elastic restoring force. As a result of this, the developing roller 54 contacts the photosensitive member 20K, so that image formation is enabled.

On the other hand, in the case where the image formation is not carried out, the developing roller 54 is separated (spaced) from the photosensitive member 20K. For this purpose, in this embodiment, as described above, the cam 205*b* as a moving means is provided. The cam 205*b* is fixed to the rotation shaft 205*a* of the developing contact and separation motor 205, and is disposed on a side opposite from the urging spring 517 while sandwiching the projected plate portion 501 therebetween. In the case where the developing roller 54 is separated from the photosensitive member 20K, the cam 205*b* is rotated by the developing contact and separation motor 205, so that the projected plate portion 501 is moved in an opposite direction (counterclockwise direction of FIG. 9) to the predetermined direction by the cam 205*b* against the urging force of the urging spring 517. As a result of this, the developing cartridge 50*a* is swung about the swing shafts 93*a* and 93*b* in the opposite direction to the predetermined direction, so that the developing roller 54 is separated from the photosensitive member 20K.

In the case where the developing roller 54 is contacted to the photosensitive member 20K, the cam 205*b* is rotated by the developing contact and separation motor 205, so that the cam 205*b* is separated from the projected plate portion 501. As a result of this, the developing cartridge 50*a* is swung in the predetermined direction by the urging force of the urging spring 517, so that the developing roller 54 contacts the photosensitive member 20K.

In the case of this embodiment, the idler gear 94 is supported by the swing shaft 93*b* and is rotated about this swing shaft 93*b*. For this reason, even when the developing cartridge 50*a* is swung relative to the developing frame 50*b*, a positional relationship between the idler gear 94 and the reduction gear 206*c* is unchanged. For this reason, even when the developing cartridge 50*a* is swung for performing mounting and dismounting of the developing roller 54 relative to the photosensitive member 20K, engagement between the idler gear 94 and the reduction gear 206*c* is not eliminated. Incidentally, in the above-described explanation, the drive is transmitted from the idler gear 94 to the gear 54*a* of the developing roller 54, but the drive from the idler gear 94 may also be transmitted to the gear 52*a* of the drawing roller 52 or the gear 58*a* of the cleaning roller 58.

When the developing cartridge 50*a* is exchanged, the developing frame 50*b* in which the developing cartridge 50*a* is mounted is pulled out together with the rail 120 from the apparatus main assembly 100A. At this time, connection between the bundle-wire 90 and the contact 91 is eliminated. Further, when the developing frame 50*b* is pulled out, with this pulling-out operation, the input drawer 92 is disconnected from the output drawer 102, and the respective positioning projections 95 are disengaged from the respective positioning holes 103. For this reason, the developing frame 50*b* is capable of being pulled out to an outside of the apparatus main assembly 100A. When the developing frame 50*b* is pulled out to the outside of the apparatus main assembly 100A, the developing cartridge 50*a* is taken out of the developing frame 50*b*. Then, a new developing cartridge 50*a* is mounted in the developing frame 50*b* again, and the developing frame 50*b* is inserted into the apparatus main assembly 100A as described above.

Further, when the developing contact and separation motor 205 and the developing roller motor 206 are exchanged, as described above, the developing frame 50*b* are pulled out together with the rail 120 from the apparatus main assembly 100A. Then, the developing frame 50*b* is dismounted from the rail 120. At this time, the developing frame 50*b* may also be exchanged together with the motor, or the motor is dismounted from the frame 510 and then a new motor may also be mounted to the frame 510. A mounting and dismounting operation of the motor relative to the frame 510 may also be performed after the developing cartridge 50*a* is dismounted from the developing frame 50*b*. In either case, the developing frame 50*b* to which a new motor is mounted is placed on the rail 120, and is inserted into the apparatus main assembly 100A.

In such a case of this embodiment, the reduction in running cost and the improvement in maintenance property can be realized. That is, when the developing roller 54 and the like such as consumable parts are periodically exchanged, the developing cartridge 50*a* is dismounted from the developing frame 50*b* provided with the driving source such as the developing roller motor 206. By this, the developing cartridge 50*a* can be exchanged alone separately from the developing frame 50*b*. As a result of this, exchange of the driving source which is not out of order does not occur, so that the running cost can be reduced.

Further, even in the case where the developing contact and separation motor 205, the developing roller motor 206 or the input drawer 92 is out of order, the developing frame 50*b* including these component parts can be dismounted from the apparatus main assembly 100A. For this reason, an exchanging operation of the component part which is out of order can be easily performed, so that the improvement in maintenance property can be realized.

The developing cartridge 50*a* can be dismounted from the developing frame 50*b* including the motors, and therefore, there is no occurrence of an operation in which the developing device is disassembled and then re-assembled for re-utilizing the motors or the like purpose. Particularly, in the constitution using the wet developing type as in this embodiment, a sealing property is impaired by the disassembling and assembling operation in some instances. In this embodiment, such an operation does not occur, and further, a component part relating to sealing property is not interposed between the developing cartridge 50*a* and the developing frame 50*b*, and therefore, a lowering in such a sealing property can be prevented.

Further, from the viewpoints of a high image quality and high definition, during image formation, the developing roller 54 may desirably be rotated at the substantially same peripheral speed as that of the photosensitive member 20K to the extent possible. In this embodiment, the developing roller motor 206 is supported by the developing frame 50*b*, and therefore, relative to the case where this motor is supported by the apparatus main assembly 100A, component parts interposed from the motor to the developing roller 54 can be reduced. Among the respective component parts, there is a tolerance, and when the number of the interposed component parts is large, the tolerance is accumulated, so that there is a liability that an error of the peripheral speed of the developing roller 54 becomes large. On the other hand, in this embodiment, the interposed component parts from the motor to the developing roller 54 can be decreased, and therefore, the error of the peripheral speed of the developing roller 54 can be made small. In the case of the constitution of this embodiment, a peripheral speed difference of the developing roller 54 relative to the photosensitive member 20K can be reduced to about ±1-3%.

Further, in this embodiment, by a simple constitution such that the developing cartridge 50*a* is made mountable to and dismountable from the developing frame 50*b*, it is possible to realize the reduction in running cost, the improvement in maintenance property, the prevention of the lowering in sealing property and the reduction in peripheral speed error of the developing roller 54 as described above.

Other Embodiments

In the above-described embodiment, the constitution in which the developing contact and separation motor 205 and the developing roller motor 206 are supported by the frame 510 of the developing frame 50*b* was employed, but a constitution in which only either one of the motors is supported by the frame 510 may also be employed. In this case, a constitution in which the other motor is assembled into a unit and is mounted in the developing device so as to be mountable to and dismountable from the developing device may also be employed. Incidentally, from the viewpoint of accuracy of the peripheral speed of the developing roller 54, at least the developing roller motor 206 may preferably be supported by the frame 510.

Further, in the above-described embodiment, the developing device using the wet developing type was described, but the present invention is also applicable to the developing device of the dry developing type using the powdery toner. For example, a developing cartridge including a developing sleeve as a developer carrying member rotatable while carrying the powdery toner is made mountable to and dismountable from a developing frame as a supporting member including a motor for rotationally driving the developing sleeve. Further, this developing frame is also made mountable to and dismountable from an apparatus main assembly. Also in the case of the developing device of such a dry developing type, the developing sleeve as a consumable part is exchanged and a motor which is cut of order is exchanged in some cases, so that similarly as in the above-described embodiment, the present invention may preferably be applicable thereto.

INDUSTRIAL APPLICABILITY

According to the present invention, there is provided a developing device which has a low running cost or which is high in maintenance property.

EXPLANATION OF SYMBOLS

50*a* . . . developing cartridge/50*b* . . . developing frame (supporting frame)/50Y, 50M, 50C, 50K . . . developing device/51 . . . film forming electrode/52 . . . drawing roller (pressing member)/53 . . . developer container/54 . . . developing roller (developer carrying member)/58 . . . cleaning blade (cleaning member)/92 . . . input drawer (second contact)/93*a*, 93*b* . . . swing shaft/94 . . . idler gear (rotation transmission member)/100A . . . apparatus main assembly/102 . . . output drawer (first contact)/104 . . . power source/205 . . . developing contact and separation motor (swing driving source)/205*b* . . . cam (moving means)/206 . . . developing roller motor (driving source)/517 . . . urging spring (urging means)

The invention claimed is:

1. An image forming apparatus comprising:

a power source;

a developing cartridge including a developing rotating member configured to carry a developer to develop an electrostatic latent image formed on an image bearing member;

a motor configured to rotationally drive said developing rotating member;

a supporting frame, dismountably mounted to said image forming apparatus, configured to dismountably support said developing cartridge and to dismountably support said motor;

an electrical contact, provided on said supporting frame, configured to electrically contact to said power source to supply electric power to said motor in a state that said supporting frame is mounted to said image forming apparatus; and a drawer portion configured to dismountably support said supporting frame and to be capable of being pulled out from said image forming apparatus to dismount said supporting frame from said image forming apparatus in a state that said supporting frame is supported.

2. An image forming apparatus according to claim 1, further comprising:

a positioning portion, provided on said supporting frame, configured to position a relative position of said supporting frame to said image forming apparatus when said supporting frame is mounted to said image forming apparatus, wherein with respect to a rotational axis direction of said developing rotating member, said motor is provided between said developing cartridge and said positioning portion.

3. A image forming apparatus according to claim 1, further comprising:

a contact/separation motor configured to cause said developing cartridge to move between a contact position where said developing rotating member is contacted to said image bearing member and a separation position where said developing member is separated from said image bearing member, wherein said supporting frame dismountably supports said contact/separation motor.

4. A image forming apparatus according to claim 1, wherein said developer includes a liquid developer containing toner and a liquid carrier.

* * * * *